US009079409B2

(12) United States Patent
Fang et al.

(10) Patent No.: US 9,079,409 B2
(45) Date of Patent: Jul. 14, 2015

(54) FLUID EJECTION DEVICES

(76) Inventors: Jiandong Fang, Lexington, KY (US); Paul Graf, Lexington, KY (US); Andrew McNees, Lexington, KY (US)

( * ) Notice: Subject to any disclaimer, the term of this patent is extended or adjusted under 35 U.S.C. 154(b) by 92 days.

(21) Appl. No.: 13/172,904

(22) Filed: Jun. 30, 2011

(65) Prior Publication Data

US 2013/0002771 A1 Jan. 3, 2013

(51) Int. Cl.

| | |
|---|---|
| ***B41J 2/145*** | (2006.01) |
| ***B41J 2/175*** | (2006.01) |
| ***B41J 2/14*** | (2006.01) |

(52) U.S. Cl.

CPC ..... *B41J 2/175* (2013.01); *B41J 2/1404* (2013.01); *B41J 2/145* (2013.01)

(58) Field of Classification Search

CPC ..... B41J 2/14145
USPC ..... 347/65, 40, 84–87, 70–75
See application file for complete search history.

(56) References Cited

U.S. PATENT DOCUMENTS

| | | | | |
|---|---|---|---|---|
| 6,402,301 | B1 * | 6/2002 | Powers et al. | 347/63 |
| 6,660,175 | B2 * | 12/2003 | Kawamura et al. | 216/27 |
| 7,041,226 | B2 * | 5/2006 | Vaideeswaran et al. | 216/27 |
| 7,077,503 | B2 * | 7/2006 | Kaneko et al. | 347/48 |
| 7,083,268 | B2 * | 8/2006 | Obert et al. | 347/65 |
| 7,905,570 | B2 * | 3/2011 | Ito | 347/20 |
| 8,087,756 | B2 * | 1/2012 | Anderson et al. | 347/61 |
| 8,297,742 | B2 * | 10/2012 | Von Essen et al. | 347/68 |
| 2003/0160842 | A1 * | 8/2003 | Min et al. | 347/65 |
| 2004/0017438 | A1 * | 1/2004 | Pollard et al. | 347/65 |
| 2006/0001704 | A1 * | 1/2006 | Anderson et al. | 347/65 |
| 2006/0012651 | A1 * | 1/2006 | Lee et al. | 347/86 |
| 2006/0213955 | A1 * | 9/2006 | Watanabe | 228/174 |
| 2009/0109256 | A1 * | 4/2009 | Nagate et al. | 347/20 |
| 2009/0295859 | A1 * | 12/2009 | Oohashi et al. | 347/17 |
| 2009/0315954 | A1 * | 12/2009 | Sakurai et al. | 347/63 |

* cited by examiner

*Primary Examiner* — Matthew Luu
*Assistant Examiner* — Lily Kemathe
(74) *Attorney, Agent, or Firm* — Amster, Rothstein, Ebenstein LLP

(57) ABSTRACT

Disclosed is a fluid ejection device for an inkjet printer that includes a substrate. The substrate includes at least one trench and a plurality of fluid flow vias configured in at least three parallel rows arranged over each trench of the at least one trench. Each row of the at least three parallel rows includes a set of fluid flow vias from the plurality of fluid flow vias arranged in one of a uniform manner and a non-uniform manner such that each fluid flow via of the set of fluid flow vias is configured in a spaced-apart relation with an adjacent fluid flow via. The each fluid flow via is configured in a diagonal relationship relative to a neighboring fluid flow via of an adjacent row of the at least three parallel rows. The fluid ejection device also includes a flow feature layer and a nozzle plate.

18 Claims, 7 Drawing Sheets

FLUID EJECTION DEVICES

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to printers, and more particularly, to fluid ejection devices for printers.

2. Description of the Related Art

A typical fluid ejection device (heater chip) for a printer, such as an inkjet printer, includes a substrate (silicon wafer) carrying at least one fluid ejection element thereupon; a flow feature layer configured over the substrate; and a nozzle plate configured over the flow feature layer. The nozzle plate and the flow feature layer of the fluid ejection device are generally formed as thick layers of polymeric materials. The flow feature layer includes flow features (fluid chambers and fluid channels), and the nozzle plate includes a plurality of nozzles. Further, the fluid ejection device includes contact pads on both end portions thereof. Furthermore, the fluid ejection device includes fluid flow vias (through ink slots) within the substrate such that nozzles of the nozzle plate are located on both sides of the fluid flow vias. In addition, circuits for digital control and power distribution are routed longitudinally along the fluid flow vias. The circuits for digital control and power distribution are coupled with the at least one fluid ejection element to provide digital and power signals to the at least one fluid ejection element.

When fabricating a narrow fluid ejection device (e.g., a heater chip of width less than about 2 millimeters (mm) with cyan, magenta, yellow, blacK, and blacK (CMYKK) fluid flow vias) for cost saving and stationary head printing purposes, wall of a fluid flow via is needed to be reduced to a dimension (width) less than about 0.2 mm. However, such a reduction in the dimension of the fluid flow via's wall may greatly challenge longitudinal circuit routing to control and fire the nozzles. Further, in-line seamless stitching of multiple fluid ejection devices requires ultra narrow (less than about 0.1 mm) solid silicon at end portions of the fluid ejection devices. Accordingly, contact pads are needed to be situated along the length of the fluid ejection devices. Further, transverse circuit routing needs to be provided through spaces among the fluid flow vias for an appropriate and optimum utilization.

FIG. 1 depicts a top view of a partial layout of a fluid ejection device 100 (without a nozzle plate and a flow feature layer) for a 1600 dots per inch (dpi) print resolution. The fluid ejection device 100 includes a substrate 110 having a thickness ranging from about 200 micrometers (μm) to about 700 μm. The substrate 110 includes at least one trench, such as trenches 112, 114, and 116, in a bottom portion (not shown) thereof. Each trench of the trenches 112, 114, and 116 has a width ranging from about 100 μm to about 120 μm, and is configured along the length of the fluid ejection device 100.

The substrate 110 further includes a plurality of fluid flow vias, such as a plurality of fluid flow vias 122, a plurality of fluid flow vias 124, and a plurality of fluid flow vias 126, arranged over the trenches 112, 114, and 116, respectively. Specifically, the fluid flow vias 122, 124, and 126 are arranged within a top portion (not shown) of the substrate 110. More specifically, the fluid flow vias 122, 124, and 126, are arranged in two rows (not numbered) over the respective trenches 112, 114, and 116, i.e., two rows of the fluid flow vias 122, 124, and 126, are laid out evenly above the respective trenches 112, 114, and 116. For the purpose of simplicity, solid space of the substrate 110 among each respective fluid flow vias of the fluid flow vias 122, 124, and 126, is not depicted and the trenches 112, 114, and 116 configured underneath are made visible in FIG. 1.

The fluid flow vias 122, 124, and 126, may be configured for fluids of specific colors. In all, the fluid ejection device 100 may include five color fluid flow vias, including the fluid flow vias 122, 124, and 126. It will be evident that the fluid flow vias 122, 124, and 126 are shown to be circular in shape. However, the fluid flow vias 122, 124, and 126 may be of any other appropriate shape, such as a rectangular shape. Further, each of the fluid flow vias 122, 124, and 126 has a depth (i.e., thickness of fluid flow via layer (not numbered)) ranging from about 30 μm to about 60 μm. The term, 'fluid flow via layer', as used herein above relates to the top portion of the substrate 110 that includes the fluid flow vias 122, 124, and 126, therewithin.

Nozzle pitch for the fluid ejection device 100 (1600 dpi print resolution) is about 31.8 μm from which width for fluid flow vias is deducted to obtain solid space for digital circuit and power routing. The term, 'nozzle pitch' for any fluid ejection device, such as the fluid ejection device 100, may be defined as an interval between centers of the recording nozzles. As depicted in FIG. 1, the restraining dimension for transverse bus routing (digital circuit and power routing) is about 31.8 μm (1"/800, i.e., 2"/1600) that defines the distance (solid space) between adjacent fluid flow vias, such as fluid flow vias 124, of a single row, as depicted by 'D1'. Assuming the print resolution is "a" dpi, then pitch of a fluid flow via is "2"/a", which is the restraining dimension for transverse bus routing after deduction of the width of the fluid flow via. Further, a fluid flow via of a typical fluid ejection device, such as the fluid ejection device 100, may have a width of about 5 μm and a length of about 16 μm. Accordingly, solid space among the fluid flow vias for digital circuit and power routing is about 26.8 μm (when width of a fluid flow via is deducted from the nozzle pitch/the distance 'D1'). Furthermore, useful space is even smaller than the aforementioned value due to alignment tolerance of fluid ejection devices. Additionally, the distance (solid space), as depicted by 'D2', between each of the fluid flow vias, such as the fluid flow vias 124, of a first row (not numbered) and a neighboring fluid flow via of the fluid flow vias 124 of a second row (not numbered), is the determining factor for a single-pass print resolution (1600 dpi), and is about 15.9 μm (1"/1600).

The fluid ejection device 100 also includes a plurality of electrical interconnects 132 configured over the substrate 110 to communicate digital signals and power signals to fluid ejection elements (not shown) of the fluid ejection device 100 through the digital circuit and power routing.

It is further to be noted that as nozzle spatial density rises for higher print resolutions, the reduced solid space among the fluid flow vias of the fluid ejection devices greatly challenges the digital circuit and power routing, and specifically power distribution lines carrying high current.

FIG. 2 depicts a top view of a partial layout of another prior art fluid ejection device 200 (without a nozzle plate and a flow feature layer) with 1800 dpi print resolution. The fluid ejection device 200 includes a substrate 210 having a thickness ranging from about 200 μm to about 700 μm. The substrate 210 includes at least one trench, such as trenches 212, 214, and 216. Each trench of the trenches 212, 214, and 216 has a width ranging from about 100 μm to about 120 μm to sustain mechanical integrity and a low cost of the fluid ejection device 200. Further, each trench of the trenches 212, 214, and 216 is configured along the length of the fluid ejection device 200, and within a bottom portion (not shown) of the substrate 210.

The substrate 210 further includes a plurality of fluid flow vias, such as a plurality of fluid flow vias 222, a plurality of fluid flow vias 224, and a plurality of fluid flow vias 226, arranged over the trenches 212, 214, and 216, respectively, and within a top portion (not shown) of the substrate 210. The fluid flow vias 222, 224, and 226, are arranged in two rows over the respective trenches 212, 214, and 216, i.e., two rows of the fluid flow vias 222, 224, and 226 are laid out evenly above the respective trenches 212, 214, and 216. It will be evident that the fluid flow vias 222, 224, and 226 are shown to be circular in shape. However, the fluid flow vias 222, 224, and 226 may be of any other appropriate shape, such as a rectangular shape. Further, each of the fluid flow vias 222, 224, and 226 has a depth (i.e., thickness of fluid flow via layer (not numbered)) ranging from about 30 μm to about 60 μm. For the purpose of simplicity, solid space of the substrate 210 among each respective fluid flow vias of the fluid flow vias 222, 224, and 226, is not depicted, and the trenches 212, 214, and 216 configured underneath are made visible in FIG. 2.

As depicted in FIG. 2, the restraining dimension for transverse bus routing (digital circuit and power routing) is about 28.2 μm (1"/900, i.e., 2"/1800) that defines the distance (solid space) between adjacent fluid flow vias, such as fluid flow vias 224, of a single row, as depicted by 'D3'. Further, a fluid flow via of a typical fluid ejection device, such as the fluid ejection device 200, may have a width of about 5 μm and a length of about 16 μm. Accordingly, solid space among fluid flow vias for digital circuit and power routing is about 23.2 μm (when width of a fluid is deducted from the nozzle pitch/the distance 'D3') that is about 3.6 μm less than that of the fluid ejection device 100. Additionally, the distance (solid space), as depicted by 'D4', between each of the fluid flow vias, such as the fluid flow vias 224, of a first row (not numbered) and a neighboring fluid flow via of the fluid flow vias 224 of a second row (not numbered) is the determining factor for a single-pass print resolution (1800 dpi), and is about 14.1 μm (1"/1800).

The fluid ejection device 200 also includes a plurality of electrical interconnects 232 configured over the substrate 210 to communicate digital signals and power signals to fluid ejection elements (not shown) of the fluid ejection device 200 through the digital circuit and power routing.

As observed from above, the solid space among the fluid flow vias, such as the fluid flow vias 224, is reduced when a fluid ejection device, such as the fluid ejection device 200 is required to achieve a high print resolution, such as 1800 dpi. Accordingly, the digital circuit and power routing is affected. Further, it becomes even more challenging when width of the fluid flow vias is required to be greater than 5 μm for either larger droplet volumes or thicker fluid flow via layer (i.e., greater than about 30 μm).

Accordingly, there persists a need for a fluid ejection device having a layout of fluid flow vias that provides an effective transverse bus routing for appropriate digital circuit and power distribution among the fluid flow vias of the fluid ejection device, such that the fluid ejection device is capable of achieving a high print resolution, such as a print resolution greater than or equal to about 1800 dpi.

SUMMARY OF THE DISCLOSURE

In view of the foregoing disadvantages inherent in the prior art, the general purpose of the present disclosure is to provide fluid ejection devices, by including all the advantages of the prior art, and overcoming the drawbacks inherent therein.

In one aspect, the present disclosure provides a fluid ejection device for an inkjet printer. The fluid ejection device includes a substrate. The substrate includes at least one trench configured therewithin. Further, the substrate includes a plurality of fluid flow vias configured in at least three parallel rows arranged over each trench of the at least one trench. Each row of the at least three parallel rows includes a set of fluid flow vias from the plurality of fluid flow vias arranged in one of a uniform manner and a non-uniform manner such that each fluid flow via of the set of fluid flow vias is configured in a spaced-apart relation with an adjacent fluid flow via of the set of fluid flow vias. The each fluid flow via of the set of fluid flow vias of the each row is configured in a diagonal relationship relative to a neighboring fluid flow via of an adjacent row of the at least three parallel rows.

The fluid ejection device also includes a flow feature layer configured over the substrate. The flow feature layer includes a plurality of flow features. Each flow feature of the plurality of flow features is configured in fluid communication with a corresponding fluid flow via of the plurality of fluid flow vias. Additionally, the fluid ejection device includes a nozzle plate configured over the flow feature layer. The nozzle plate includes a plurality of nozzles. Each nozzle of the plurality of nozzles is configured in fluid communication with a corresponding flow feature of the plurality of flow features.

In another aspect, the present disclosure provides a substrate for a fluid ejection device of an inkjet printer. The substrate includes at least one trench configured therewithin. Further, the substrate includes a plurality of fluid flow vias configured in at least three parallel rows arranged over each trench of the at least one trench. Each row of the at least three parallel rows includes a set of fluid flow vias from the plurality of fluid flow vias arranged in one of a uniform manner and a non-uniform manner such that each fluid flow via of the set of fluid flow vias is configured in a spaced-apart relation with an adjacent fluid flow via of the set of fluid flow vias. The each fluid flow via of the set of fluid flow vias of the each row is configured in a diagonal relationship relative to a neighboring fluid flow via of an adjacent row of the at least three parallel rows.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides a fluid ejection device (heater chip) for a printer, and more specifically, an inkjet printer. The fluid ejection device includes a substrate that has at least one trench configured therewithin, and a plurality of fluid flow vias configured in at least three parallel rows arranged over each trench of the at least one trench. Each row of the at least three parallel rows includes a set of fluid flow vias from the plurality of fluid flow vias arranged in one of a uniform manner and a non-uniform manner such that each fluid flow via of the set of fluid flow vias is configured in a spaced-apart relation with an adjacent fluid flow via of the set of fluid flow vias. The each fluid flow via of the set of fluid flow vias of the each row is configured in a diagonal relationship relative to a neighboring fluid flow via of an adjacent row of the at least three parallel rows.

The fluid ejection device also includes a flow feature layer configured over the substrate. The flow feature layer includes a plurality of flow features. Additionally, the fluid ejection device includes a nozzle plate configured over the flow feature layer. The nozzle plate includes a plurality of nozzles.

Various embodiments of the fluid ejection device of the present disclosure are explained with reference to FIGS. 3-13.

Figure 3:
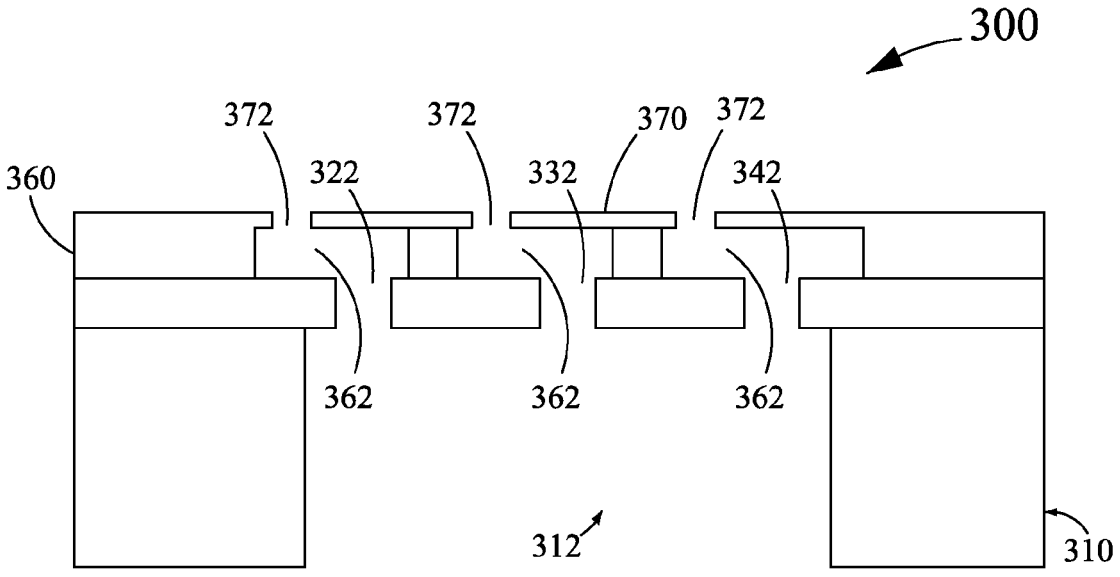
FIG. 3 depicts a partial cross-sectional side view of a fluid ejection device, in accordance with an embodiment of the present disclosure.
Figure 4:
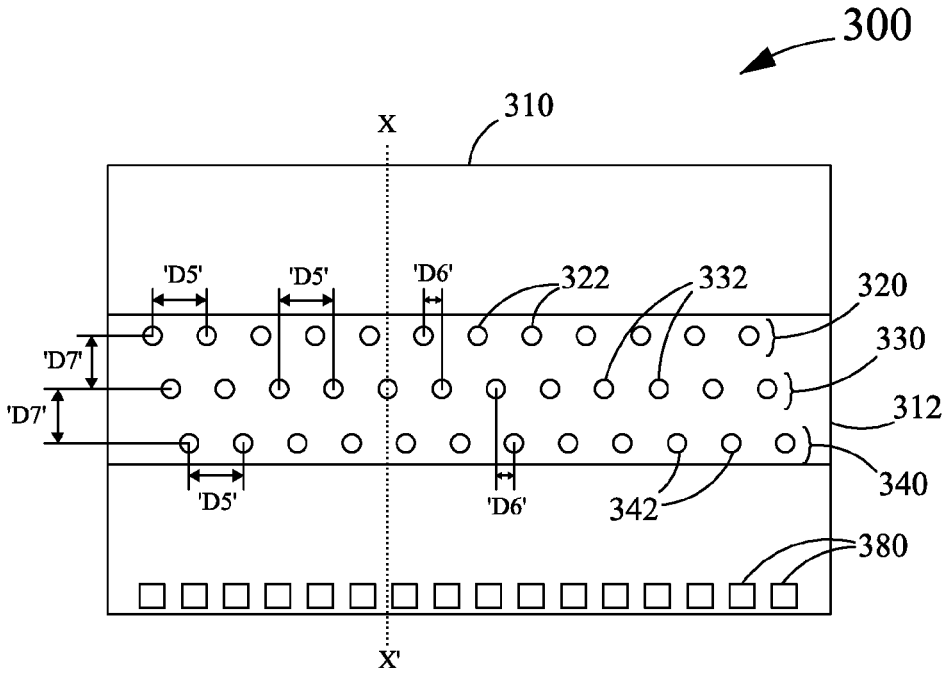
FIG. 4 depicts a top view of a partial layout of the fluid ejection device of FIG. 3 (without a nozzle plate and a flow feature layer), in accordance with an embodiment of the present disclosure.
Figure 5:
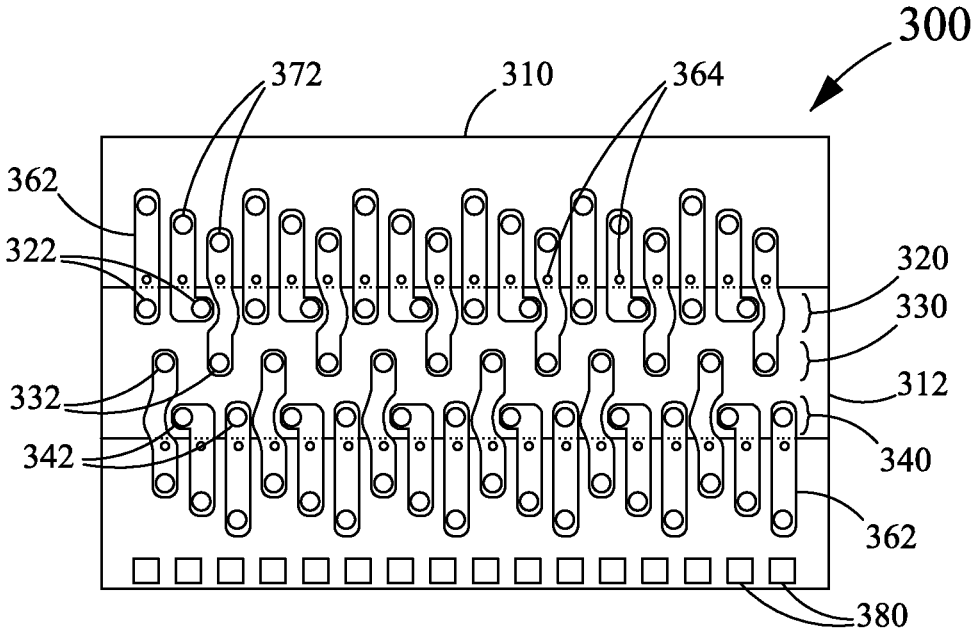
FIG. 5 depicts a top view of a partial layout of the fluid ejection device of FIG. 4 illustrating a layout of flow features of the flow feature layer and nozzles of the nozzle plate.
Figure 6:
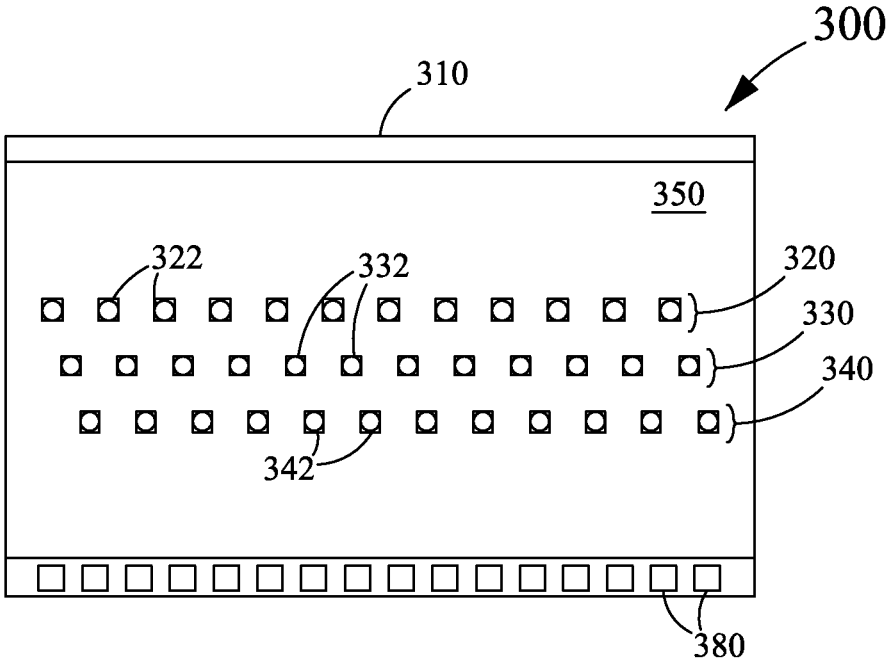
FIG. 6 depicts a top view of a partial layout of the fluid ejection device of to FIG. 4 illustrating a layout of transverse bus routing.

Referring to FIGS. 3-6, a fluid ejection device 300 for an inkjet printer, in accordance with an embodiment of the present disclosure, is disclosed. FIG. 3 depicts a partial cross-sectional side view of the fluid ejection device 300. FIG. 4 depicts a top view of a partial layout of the fluid ejection device 300 (without a nozzle plate and a flow feature layer). Further, FIG. 3 is the partial cross-sectional side view of the fluid ejection device 300 of FIG. 4 along the line X-X', with the nozzle plate and the flow feature layer. FIG. 5 depicts a top view of a partial layout of the fluid ejection device 300 illustrating a layout of to flow features of the flow feature layer and nozzles of the nozzle plate. FIG. 6 depicts a top view of a partial layout of the fluid ejection device 300 illustrating a layout of transverse bus routing. The fluid ejection device 300 is an ejection device with 1800 dpi print resolution.

As depicted in FIGS. 3-6, the fluid ejection device 300 includes a substrate 310 (such as a silicon wafer). The substrate 310 has a thickness ranging from about 200 micrometers (μm) to about 700 μm. The substrate 310 includes at least one trench, such as a trench 312, configured therewithin, as depicted in FIGS. 3-5. It is to be understood that the fluid ejection device 300 is shown to include only one trench. However, any number of trenches may be configured within the fluid ejection device 300, and more specifically, within the substrate 310, as per a manufacturer's preference. Further, the trench 312 may be configured in a bottom portion (not numbered) of the substrate 310 (as depicted in FIG. 3), and along a length of the fluid ejection device 300, and more specifically, the substrate 310. The trench 312 has a width ranging from about 100 μm to about 150 μm.

The substrate 310 also includes a plurality of fluid flow vias configured in at least three parallel rows, and more specifically, in three parallel rows, such as a first row 320, a second row 330, and a third row 340, arranged over the trench 312, as depicted in FIGS. 4 and 5. Specifically, the plurality of fluid flow vias may be configured in a top portion (not numbered) of the substrate 310, as depicted in FIG. 3. Each row of the first row 320, the second row 330, and the third row 340, includes a set of fluid flow vias from the plurality of fluid flow vias arranged in a uniform manner (evenly distributed) such that each fluid flow via of the set of fluid flow vias is configured in a spaced-apart relation with an adjacent fluid flow via of the first set of fluid flow vias, as depicted in FIGS. 4-6. Specifically, the first row 320 includes a first set of fluid flow vias 322, arranged in a uniform manner such that each fluid flow via of the first set of fluid flow vias 322 is configured in a spaced-apart relation with an adjacent fluid flow via of the first set of fluid flow vias 322. More specifically, the each fluid flow via of the first set of fluid flow vias 322 is arranged at a predetermined distance of about 1"/600 (3"/1800), i.e., 42.3

μm (wide gap), from the adjacent fluid flow via, as depicted by distance 'D5', thereby resulting in the uniform arrangement, as depicted in FIG. 4.

Similarly, the second row 330 includes a second set of fluid flow vias 332, arranged in a uniform manner such that each fluid flow via of the second set of fluid flow vias 332 is configured in a spaced-apart relation with an adjacent fluid flow via of the second set of fluid flow vias 332. More specifically, the each fluid flow via of the second set of fluid flow vias 332 is arranged at a predetermined distance of about 1"/600 (3"/1800), i.e., 42.3 μm (wide gap), from the adjacent fluid flow via, as depicted by distance 'D5', thereby resulting in the uniform arrangement. Further, the third row 340 includes a third set of fluid flow vias 342, arranged in a uniform manner such that each fluid flow via of the third set of fluid flow vias 342 is configured in a spaced-apart relation with an adjacent fluid flow via of the third set of fluid flow vias 342. More specifically, the each fluid flow via of the third set of fluid flow vias 342 is arranged at a predetermined distance of about 1"/600 (3"/1800), i.e., 42.3 μm (wide gap), from the adjacent fluid flow via, as depicted by distance 'D5', thereby resulting in the uniform arrangement. Accordingly, the predetermined distance between the adjacent fluid flow vias (every two fluid flow vias) of the first set of fluid flow vias 322 of the first row 320 is equal to the predetermined distance between the adjacent fluid flow vias (every two fluid flow vias) of the second set of fluid flow vias 332 of the second row 330 and the predetermined distance between the adjacent fluid flow vias (every two fluid flow vias) of the third set of fluid flow vias 342 of the third row 340.

The each fluid flow via of the first set of fluid flow vias 322, the second set of fluid flow vias 332, and the third set of fluid flow vias 342, of the each respective first row 320, the second row 330, and the third row 340, is configured in fluid communication with the trench 312 of the at least one trench. Further, the each fluid flow via of the first set of fluid flow vias 322, the second set of fluid flow vias 332, and the third set of fluid flow vias 342, of the respective first row 320, the second row 330, and the third row 340, is further configured in a diagonal relationship relative to a neighboring fluid flow via of an adjacent row of the at least three parallel rows. Specifically, the each fluid flow via of the first set of fluid flow vias 322 of the first row 320 is configured in a diagonal relationship relative to a neighboring fluid flow via of the second set of fluid flow vias 332 of the adjacent second row 330. Similarly, the each fluid flow via of the second set of fluid flow vias 332 of the second row 330 is configured in a diagonal relationship relative to a neighboring fluid flow via of the third set of fluid flow vias 342 of the adjacent third row 340. As depicted in FIG. 4, the each fluid flow via of the first set of fluid flow vias 322 is spaced apart from a corresponding neighboring fluid flow via of the second set of fluid flow vias 332 by a distance of about 1"/1800, i.e., 14.1 μm (narrow gap), as depicted by distance 'D6'. Similarly, the each fluid flow via of the second set of fluid flow vias 332 is spaced apart from a corresponding neighboring fluid flow via of the third set of fluid flow vias 342 by the distance of about 1"/1800, i.e., 14.1 μm, as depicted by the distance 'D6'. Thus, the distance 'D6' is the determining factor for a single-pass print resolution of about 1800 dpi. Further, the second row 330 is configured at a first predetermined gap of about 1"/600, i.e., 42.3 μm, from the first row 320. Similarly, the third row 340 is configured at a second predetermined gap of about 1"/600 (3"/1800), i.e., 42.3 μm (wide gap), from the second row 330. Accordingly, gap/distance between the first row 320 and the second row 330 is equal to the gap/distance between the second row 330 and the third row 340, as depicted by 'D7' in FIG. 4.

Also, the each fluid flow via of the first set of fluid flow vias 322, the second set of fluid flow vias 332, and the third set of fluid flow vias 342 may have a width of about 5 μm and a length of about 16 μm. Without departing from the scope of the present disclosure, the each fluid flow via may have a different width and length based on a manufacturer's preference. Further, the each fluid flow via is configured to have a depth (i.e., thickness of a fluid flow via layer (not numbered)) ranging from about 10 μm to about 100 μm, and more specifically, from about 30 μm to about 60 μm. The term, 'fluid flow via layer', as used herein above relates to the top portion of the substrate 310 that includes first set of fluid flow vias 322, the second set of fluid flow vias 332, and the third set of fluid flow vias 342, therewithin.

For the purpose of simplicity, solid space of the substrate 310 among each respective fluid flow vias of the first set of fluid flow vias 322, the second set of fluid flow vias 332, and the third set of fluid flow vias 342, is not depicted, and the trench 312 configured underneath is made visible in FIGS. 4 and 5. Further, it will be evident that each of the first set of fluid flow vias 322, the second set of fluid flow vias 332, and the third set of fluid flow vias 342, is shown to be circular in shape. However, the each of the first set of fluid flow vias 322, the second set of fluid flow vias 332, and the third set of fluid flow vias 342 may be of any other appropriate shape, such as a rectangular shape.

Figure 1:
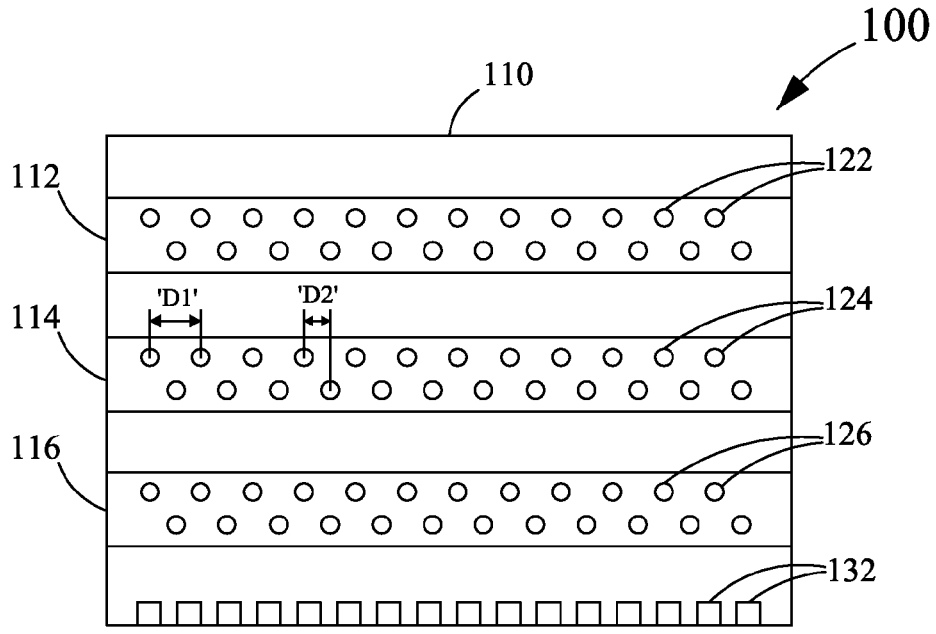
Figure 1 (Prior art)
FIG. 1 depicts a top view of a partial layout of a prior art fluid ejection device (without a nozzle plate and a flow feature layer)
Figure 2:
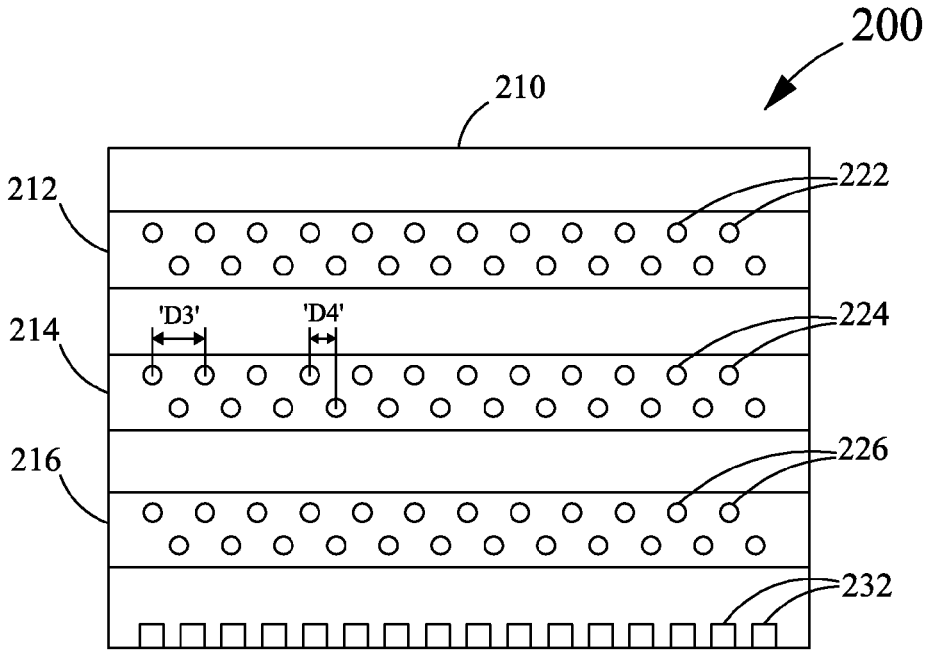
Figure 2 (Prior art)
FIG. 2 depicts a top view of a partial layout of another prior art fluid ejection device (without a nozzle plate and a flow feature layer)

Based on the aforementioned, the arrangement of the plurality of fluid flow vias in the first row 320, the second row 330, and the third row 340, above the trench 312, assists in achieving wider space among the plurality of fluid flow vias for transverse bus routing. Further, by virtue of such an arrangement, space among the plurality of fluid flow vias, i.e., the adjacent fluid flow vias of the first set of fluid flow vias 322, the adjacent fluid flow vias of the second set of fluid flow vias 332, and the adjacent fluid flow vias of the third set of fluid flow vias 342, increases from about 1"/900 to 1"/600 (difference of about 1"/1800) when compared to a prior art fluid ejection device, such as the fluid ejection device 200, for the 1800 dpi print resolution. Specifically, the restraining dimension for transverse bus routing (digital circuit and power routing) is about 28.2 μm (1"/900, i.e., 2"/1800) that defines the distance (solid space) between the adjacent fluid flow vias, such as the fluid flow vias 224, of the single row, as depicted by 'D3' in FIG. 2.

Conversely, the restraining dimension for transverse bus routing (digital circuit and power routing) is about 1"/600, i.e., 42.3 μm, defined by the distance between every two adjacent fluid flow vias of the first set of fluid flow vias 322, between every two adjacent fluid flow vias of the second set of fluid flow vias 332, and between every two adjacent fluid flow vias of the third set of fluid flow vias 342, (as depicted by distance 'D5'). Specifically, fluid flow via pitch for the plurality of fluid flow vias is about 3"/1800 (i.e., 1"/600, which is the restraining dimension for the transverse bus routing after deduction of fluid flow via width) when the print resolution of the fluid ejection device 300 is assumed to be 1800 dpi. Thus, the fluid flow via pitch in each row for the fluid ejection device 300 is uniform, and there exist wider spaces in each row among the first set of fluid flow vias 322, the second set of fluid flow vias 332, and the third set of fluid flow vias 342, equal to about 3"/1800, indicating about 50 percent improvement in comparison to the conventional two-row design of fluid ejection devices, such as the fluid ejection device 200.

FIG. 6 depicts a useful space 350 among the plurality of fluid flow vias for the transverse bus routing.

Furthermore, each row of the first row 320, the second row 330, and the third row 340, is uniformly distributed with a spacing (distance) of about 3"/1800 (i.e., 42.3 μm, as depicted by the distance 'D7') relative to an adjacent row thereof. Accordingly, the distance between the first row 320 and the second row 330, and the second row 330 and the third row 340, is also set identical to the restraining dimension 3"/1800 for appropriate transverse bus routing, and thus transverse bus routing may easily take detours on encountering the plurality of fluid flow vias. Additionally, each neighboring row, and more specifically, lower row, such as the second row 330 with reference to the first row 320, and the third row 340 with reference to the second row 330, is shifted by a gap of about 1"/1800 (i.e., 14.1 μm, as depicted by the distance 'D6') to the right relative to the adjacent upper row, i.e., the first row 320 and the second row 330, respectively. Such an arrangement of the second row 330 and the third row 340 assists in achieving the diagonal relationship between the each fluid flow via of the first set of fluid flow vias 322 and the neighboring fluid flow via of the second set of fluid flow vias 332, and between the each fluid flow via of the second set of fluid flow vias 332 and the neighboring fluid flow via of the third set of fluid flow vias 342. It will be evident that all the aforementioned distances ('D5', 'D6', and 'D7') are taken from centers (not numbered) of the respective fluid flow vias, as depicted in FIG. 4.

The fluid ejection device 300 further includes a flow feature layer 360 configured over the substrate 310, as depicted in FIG. 3. The flow feature layer 360 includes a plurality of flow features 362. The flow features 362 may be separated by a wall (not numbered in FIG. 3) therebetween, such that each of the flow features 362 is configured in fluid communication with a corresponding fluid flow via (single) of the plurality of fluid flow vias, as depicted in FIG. 5. The each of the flow features 362 may include a fluid chamber and a flow channel. Further, the each of the flow features 362 of the fluid ejection device 300 may also include one or more filtering pillars, such as a filtering pillar 364 configured therewithin. Furthermore, the fluid ejection device 300 includes a nozzle plate 370 configured over the flow feature layer 360, as depicted in FIG. 3. As depicted, the nozzle plate 370 and the flow feature layer 360 may be configured as a single unit. Alternatively, the nozzle plate 370 and the flow feature layer 360 may be configured as separate units. The nozzle plate 370 includes a plurality of nozzles 372. Each of the nozzles 372 is configured in fluid communication with a corresponding flow feature (single) of the flow features 362, as depicted in FIG. 5. Further, and as depicted in FIG. 5, each nozzle-fluid flow via pair is provided to be in fluid communication through the corresponding flow feature, and has the same length of flow path for identical/uniform flow resistance. The flow path for three nozzle-fluid flow via pairs is also depicted in FIG. 3 that illustrates a layout of fluid flow vias, such as a fluid flow via of the first set of fluid flow vias 322, a fluid flow via of the second set of fluid flow vias 332, and a fluid flow via of the third set of fluid flow vias 342, present in fluid communication with three nozzles of the nozzles 372 through three flow features of the flow features 362.

The fluid ejection device 300 may include a plurality of fluid ejection elements (not shown) fabricated over the substrate 310 for ejection of a fluid (ink) therefrom. Each fluid ejection element of the plurality of fluid ejection elements may be configured in fluid communication with corresponding one or more fluid flow vias of the plurality of fluid flow vias. Specifically, the fluid may be provided to the trench 312 from one or more fluid reservoirs and may be allowed to flow from the trench 312 to the one or more fluid flow vias, such as one or more fluid flow vias of the first set of fluid flow vias 322, the second set of fluid flow vias 332, and the third set of fluid flow vias 342. For the purpose of simplicity, the plurality of fluid ejection elements is not shown in FIGS. 3-6. However, it will be evident that the each fluid ejection element of the plurality of fluid ejection elements may be a fluid ejection element (for example, a resistor) as known in the art.

The fluid ejection device 300 further includes a plurality of electrical interconnects 380 disposed on the substrate 310, as depicted in FIGS. 4-6. Each of the electrical interconnects 380 is configured to communicate at least one of digital signals and power signals to one or more corresponding fluid ejection elements of the plurality of fluid ejection elements through respective digital circuits and power routing. The digital circuits and the power routing are distributed through the space 350 surrounding the plurality of fluid flow vias.

It will be evident that the fluid ejection device 300 having the substrate 310, the flow feature layer 360, the nozzle plate 370, and other components, may be fabricated using any technique known in the art.

Figure 7:
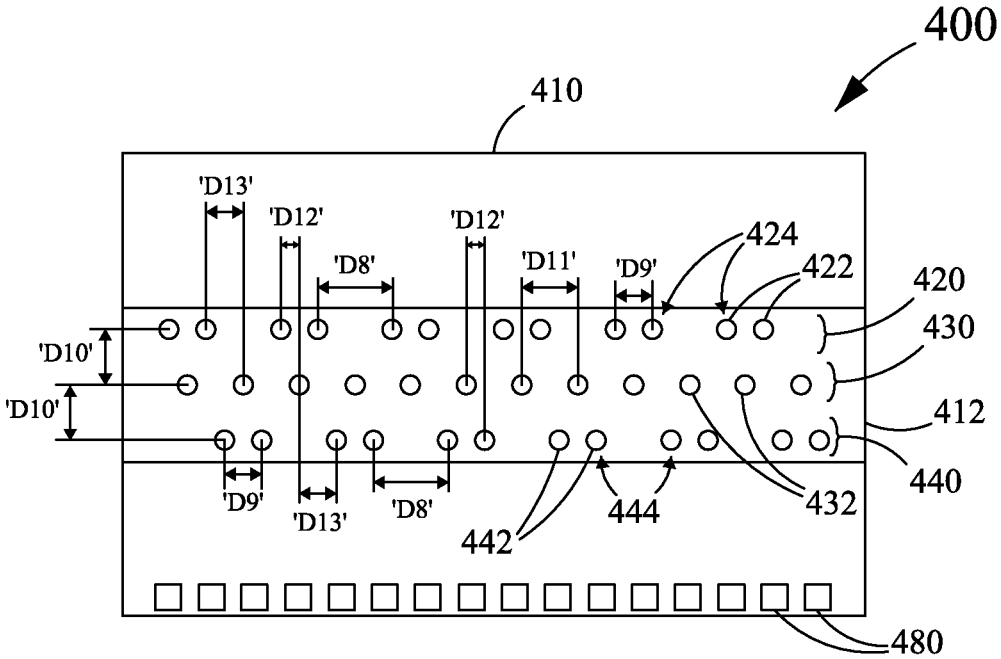
FIG. 7 depicts a top view of a partial layout of a fluid ejection device (without a nozzle plate and a flow feature layer), in accordance with another embodiment of the present disclosure.
Figure 8:
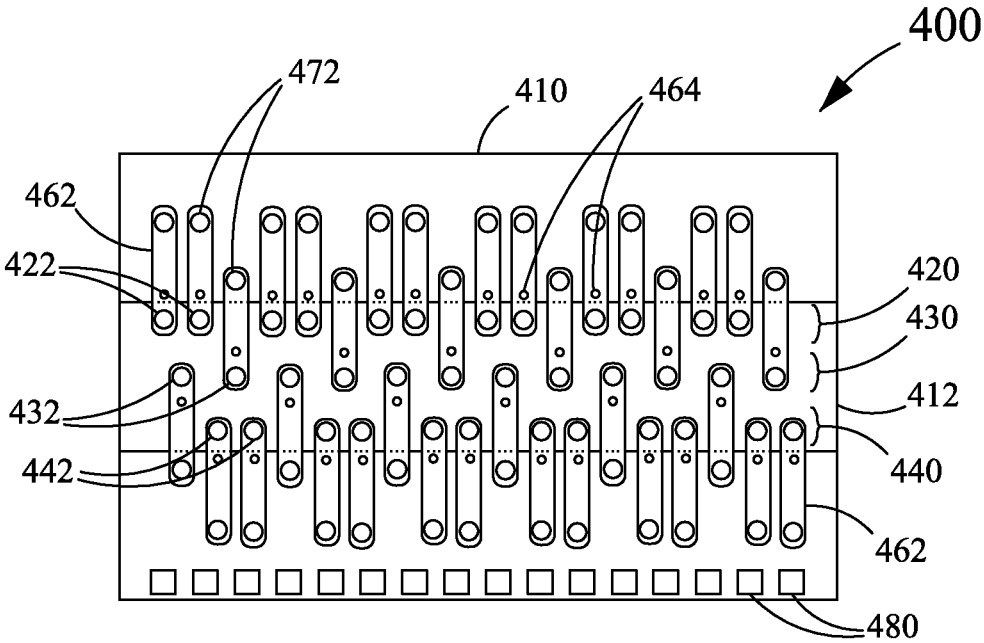
FIG. 8 depicts a top view of a partial layout of the fluid ejection device of FIG. 7 illustrating a layout of flow features of the flow feature layer and nozzles of the nozzle plate.
Figure 9:
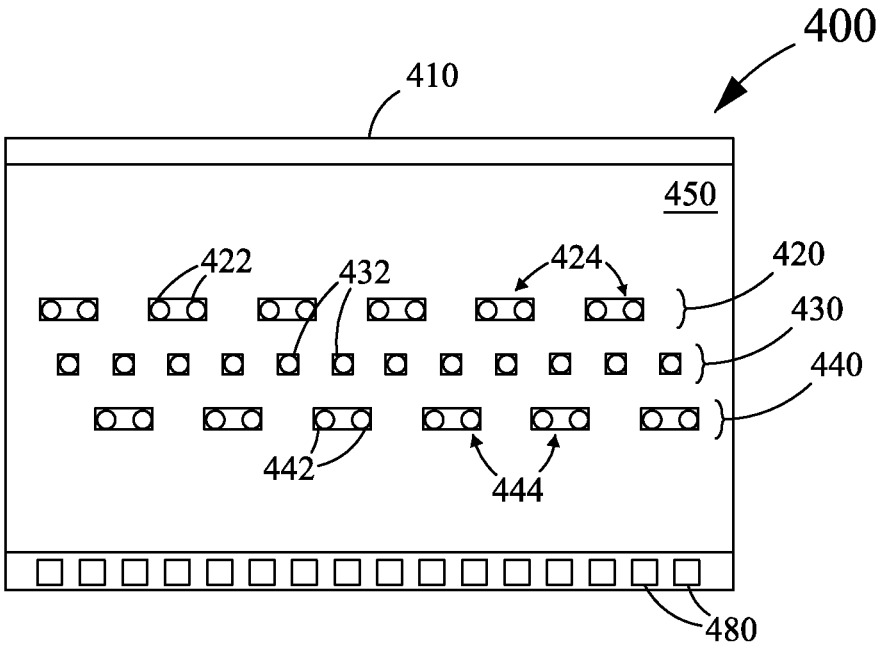
FIG. 9 depicts a top view of a partial layout of the fluid ejection device of FIG. 7 illustrating a layout of transverse bus routing.

Referring to FIGS. 7-9, a fluid ejection device 400 for an inkjet printer, in accordance with another embodiment of the present disclosure, is disclosed. FIG. 7 depicts a top view of a partial layout of the fluid ejection device 400 (without a nozzle plate and a flow feature layer). FIG. 8 depicts a top view of a partial layout of the fluid ejection device 400 illustrating a layout of flow features of the flow feature layer and nozzles of the nozzle plate. FIG. 9 depicts a top view of a partial layout of the fluid ejection device 400 illustrating a layout of transverse bus routing. The fluid ejection device 400 is similar to the fluid ejection device 300, and is an ejection device with 1800 dpi print resolution.

As depicted in FIGS. 7-9, the fluid ejection device 400 includes a substrate 410 (such as a silicon wafer). The substrate 410 has a thickness ranging from about 200 μm to about 700 μm. Further, the substrate 410 includes at least one trench, such as a trench 412, configured therewithin, as depicted in FIGS. 7 and 8. It is to be understood that the fluid ejection device 400 is shown to include only one trench. However, any number of trenches may be configured within the fluid ejection device 400, and more specifically, within the substrate 410, as per a manufacturer's preference. Further, the trench 412 is similar to the trench 312, and accordingly, a description of the trench 412 is avoided herein for the sake of brevity.

The substrate 410 also includes a plurality of fluid flow vias configured in at least three parallel rows, and more specifically, in three parallel rows, such as a first row 420, a second row 430, and a third row 440, arranged over the trench 412, as depicted in FIGS. 7 and 8. Specifically, the plurality of fluid flow vias may be configured in a top portion (not shown) of the substrate 410.

The first row 420 includes a first set of fluid flow vias 422 from the plurality of fluid flow vias arranged in a non-uniform manner. The first set of fluid flow vias 422 includes a plurality of groups 424 having at least two fluid flow vias 422. In the present embodiment, each of the groups 424 includes two fluid flow vias 422. Further, the each of the groups 424 having the two fluid flow vias 422 is configured at a predetermined distance from an adjacent group of the groups 424, as depicted by a distance 'D8' in FIG. 7. Specifically, the each group is arranged at a predetermined distance of about 4"/1800, i.e., 56.44 μm, from the adjacent group. Furthermore, each fluid flow via of the each group of the groups 424 is configured in a spaced-apart relation with an adjacent fluid flow via of the respective each group, as depicted by a distance 'D9'. Specifically, the each fluid flow via of the each group is arranged at a predetermined distance of about 1"/900, i.e., 28.2 μm, from the adjacent fluid flow via of the respective each group. Accordingly, each fluid flow via of the first set of fluid flow vias 422 is configured in a spaced-apart relation with an adjacent fluid flow via of the first set of fluid flow vias 422.

The second row 430 is configured at a first predetermined gap from the first row 420, as depicted by a gap/distance 'D10' in FIG. 7. Specifically, the second row 430 is arranged at a first predetermined gap ranging from about 1"/600, i.e., 42.3 μm, to about 1"/300, i.e., 84.6 μm, from the first row 420. Further, the second row 430 includes a second set of fluid flow vias 432 from the plurality of fluid flow vias arranged in a uniform manner (evenly distributed), such that each fluid flow via of the second set of fluid flow vias 432 is arranged at a predetermined distance from an adjacent fluid flow via, as depicted by a distance 'D11'. Specifically, the each fluid flow via is arranged at a predetermined distance of about 1"/600, i.e., 42.3 μm, from the adjacent fluid flow via. Accordingly, the each fluid flow via of the second set of fluid flow vias 432 is configured in a spaced-apart relation with the adjacent fluid flow via of the second set of fluid flow vias 432. Further, the distance 'D11' serves as the restraining dimension for transverse bus routing for the fluid ejection device 400.

The third row 440 is configured at a second predetermined gap from the second row 430, as depicted by the gap/distance 'D10'. Specifically, the third row 440 is arranged at a second predetermined gap ranging from about 1"/600, i.e., 42.3 μm, to about 1"/300, i.e., 84.6 μm, from the second row 430. Further, the third row 440 includes a third set of fluid flow vias 442 from the plurality of fluid flow vias arranged in a non-uniform manner. The third set of fluid flow vias 442 includes a plurality of groups 444 having at least two fluid flow vias 442. In the present embodiment, each of the groups 444 includes two fluid flow vias 442. Further, the each group of the groups 444 having the two fluid flow vias 442 is configured at a predetermined distance from an adjacent group of the groups 444, as depicted by the distance 'D8' in FIG. 7. Specifically, the each group is arranged at a predetermined distance of about 4"/1800, i.e., 56.44 μm, from the adjacent group. Thus, the predetermined distance between the adjacent groups of the groups 444 in the third row 440 is equal to the predetermined distance between the adjacent groups of the groups 424 in the first row 420.

Furthermore, each fluid flow via of the each group of the groups 444 is configured in a spaced-apart relation with an adjacent fluid flow via of the respective each group, as depicted by the distance 'D9'. Specifically, the each fluid flow via of the each group is arranged at a predetermined distance of about 1"/900, i.e., 28.2 μm, from the adjacent fluid flow via of the respective each group. Accordingly, each fluid flow via of the third set of fluid flow vias 442 is configured in a spaced-apart relation with an adjacent fluid flow via of the third set of fluid flow vias 442.

The each fluid flow via of the first set of fluid flow vias 422, the second set of fluid flow vias 432, and the third set of fluid flow vias 442, of the each respective first row 420, the second row 430, and the third row 440, is configured in fluid communication with the trench 412 of the at least one trench. Further, the each fluid flow via of the first set of fluid flow vias 422, the second set of fluid flow vias 432, and the third set of fluid flow vias 442, of the respective first row 420, the second row 430, and the third row 440, is further configured in a diagonal relationship relative to a neighboring fluid flow via of an adjacent row of the at least three parallel rows. Specifically, the each fluid flow via of the first set of fluid flow vias 422 of the first row 420 is configured in a diagonal relationship relative to a neighboring fluid flow via of the second set of fluid flow vias 432 of the adjacent second row 430. Similarly, the each fluid flow via of the second set of fluid flow vias 432 of the second row 430 is configured in a diagonal relationship relative to a neighboring fluid flow via of the third set of fluid flow vias 442 of the adjacent third row 440. As depicted in FIG. 7, the each fluid flow via of the first set of fluid flow vias 422 is spaced apart from the closest neighboring fluid flow via of the second set of fluid flow vias 432 by a distance of about 1"/1800, i.e., 14.1 μm, as depicted by the distance 'D12' (relative shift). Thus, the distance 'D12' is the determining factor for a single-pass print resolution of about 1800 dpi. Further, the each fluid flow via of the first set of fluid flow vias 422 is spaced apart from the next closest neighboring fluid flow via of the second set of fluid flow vias 432 by a distance of about 1"/900, i.e., 28.2 μm, as depicted by a distance 'D13' (relative shift). Similarly, the each fluid flow via of the third set of fluid flow vias 442 is spaced apart from the closest neighboring fluid flow via of the second set of fluid flow vias 432 by a distance of about 1"/1800, i.e., 14.1 μm, as depicted by the distance 'D12'. Further, the each fluid flow via of the third set of fluid flow vias 442 is spaced apart from the next closest neighboring fluid flow via of the second set of fluid flow vias 432 by a distance of about 1"/900, i.e., 28.2 μm, as depicted by the distance 'D13'.

Also, the each fluid flow via of the first set of fluid flow vias 422, the second set of fluid flow vias 432, and the third set of fluid flow vias 442, may have a width of about 5 μm and a length of about 16 μm. Without departing from the scope of the present disclosure, the each fluid flow via may have a different width and length based on a manufacturer's preference. Further, the each fluid flow via is configured to have a depth (i.e., thickness of a fluid flow via layer (not numbered)) ranging from about 10 μm to about 100 μm, and more specifically, from about 30 μm to about 60 μm. The term, 'fluid flow via layer', as used herein above relates to the top portion of the substrate 410 that includes the plurality of fluid flow vias therewithin.

For the purpose of simplicity, solid space of the substrate 410 among each respective fluid flow vias of the first set of fluid flow vias 422, the second set of fluid flow vias 432, and the third set of fluid flow vias 442, is not depicted, and the trench 412 configured underneath is made visible in FIGS. 7 and 8. Further, it will be evident that the each of the plurality of fluid flow vias is shown to be circular in shape. However, the each of the plurality of fluid flow vias may be of any other appropriate shape, such as a rectangular shape.

Based on the aforementioned, the arrangement of the plurality of fluid flow vias in the first row 420, the second row 430, and the third row 440, above the trench 412, assists in achieving wider space among the plurality of fluid flow vias for transverse bus routing. FIG. 9 depicts a useful space 450 among the plurality of fluid flow vias for the transverse bus routing. Further, by virtue of such an arrangement, the restraining dimension for transverse bus routing (digital circuit and power routing) is about 42.3 μm (1"/600) that defines the distance (solid space) between the adjacent fluid flow vias of the second set of fluid flow vias 432, as depicted by the distance 'D11' in FIG. 7. Also, the fluid ejection device 400 includes the second row 430 with the uniform arrangement of the second set of fluid flow vias 432 evenly distributed at 3"/1800 spacing (distance 'D11', wider gaps); and the first row 420 and the third row 440 with multiple groups of two 1"/900 spaced fluid flow vias, i.e., the groups 424 and 444, separated at a distance of about 4"/1800 (edge-to-edge distance 'D8'; wider gaps), which is greater than the spacing among the second set of fluid flow vias 432. Furthermore, gaps/distances between the first row 420 and the second row 430; and the second row 430 and the third row 440 are also set to further facilitate appropriate transverse bus routing, while allowing the transverse bus routing to take detours on encountering the plurality of fluid flow vias.

Additionally and as depicted in FIGS. 7-9, the each group of the groups 424 in the first row 420 forms a triangle with a corresponding neighboring fluid flow via of the fluid flow vias 432 of the second row 430. Further, the each group of the groups 444 in the third row 440 forms a triangle with a corresponding neighboring fluid flow via of the fluid flow vias 432 of the second row 430. Therefore, the plurality of fluid flow vias is configured as two rows of triangles (each fluid flow via denoting one vertex of a triangle) facing each other, wherein the wider gaps (contributed by 'D8' and 'D11') between adjacent upper and lower triangles provide spaces for transverse bus routing, and specifically, for power distribution lines to transport high current, and the narrow gaps (contributed by 'D9' and 'D13') provide spacing for digital circuit routing.

It will be evident that all the aforementioned distances ('D8', 'D9', 'D10', 'D11', 'D12' and 'D13') are taken from centers (not numbered) of the respective fluid flow vias, as depicted in FIG. 7.

The fluid ejection device 400 further includes a flow feature layer (not shown), such as the flow feature layer 360 of FIG. 3, configured over the substrate 410. The flow feature layer includes a plurality of flow features 462, as depicted in FIG. 8. Each of the flow features 462 is configured in fluid communication with a corresponding fluid flow via of the plurality of fluid flow vias. The each of the flow features 462 may include a fluid chamber and a flow channel. Further, the each of the flow features 462 of the fluid ejection device 400 may also include one or more filtering pillars, such as a filtering pillar 464 configured therewithin. Furthermore, the fluid ejection device 400 includes a nozzle plate (not shown), such as the nozzle plate 370 of FIG. 3, configured over the flow feature layer. The nozzle plate includes a plurality of nozzles 472, as depicted in FIG. 8. Each of the nozzles 472 is configured in fluid communication with a corresponding flow feature of the flow features 462. Further, and as depicted in FIG. 8, each nozzle-fluid flow via pair is provided to be in fluid communication through the corresponding flow feature, and has the same length of flow path for identical/uniform flow resistance.

It will be evident that the nozzle plate and the flow feature layer may be configured as a single unit. Alternatively, the nozzle plate and the flow feature layer may be configured as separate units.

The fluid ejection device 400 may also include a plurality of fluid ejection elements (not shown) fabricated over the substrate 410 for ejection of a fluid (ink) therefrom. Each fluid ejection element of the plurality of fluid ejection elements may be configured in fluid communication with corresponding one or more fluid flow vias of the plurality of fluid flow vias. Specifically, the fluid may be provided to the trench 412 from one or more fluid reservoirs and may be allowed to flow from the trench 412 to the one or more fluid flow vias, such as one or more fluid flow vias of the first set of fluid flow vias 422, the second set of fluid flow vias 432, and the third set of fluid flow vias 442. For the purpose of simplicity, the plurality of fluid ejection elements is not shown in FIGS. 7-9. However, it will be evident that the each fluid ejection element of the plurality of fluid ejection elements may be a fluid ejection element (for example, a resistor) as known in the art.

The fluid ejection device 400 further includes a plurality of electrical interconnects 480 disposed on the substrate 410. Each of the electrical interconnects 480 is configured to communicate at least one of digital signals and power signals to one or more corresponding fluid ejection elements of the plurality of fluid ejection elements through respective digital circuits and power routing. The digital circuits and the power routing are distributed through the space 450 surrounding the plurality of fluid flow vias.

It will be evident that the fluid ejection device 400 having the substrate 410, the flow feature layer, the nozzle plate, and other components, may be fabricated using any technique known in the art.

Figure 10:
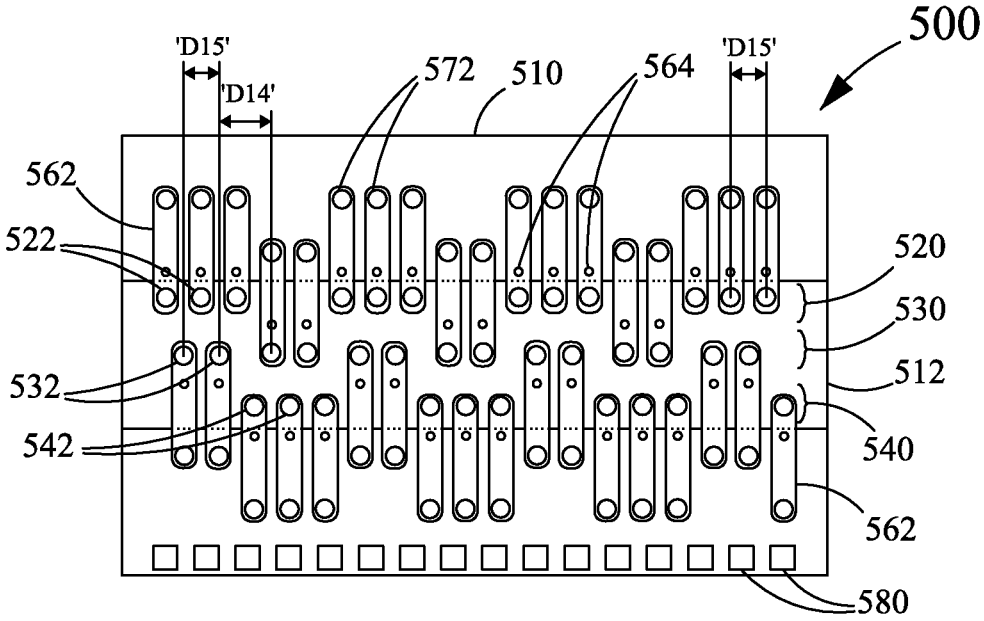
FIG. 10 depicts a top view of a partial layout of a fluid ejection device illustrating a layout of flow features of a flow feature layer and nozzles of a nozzle plate, in accordance with yet another embodiment of the present disclosure.
Figure 11:
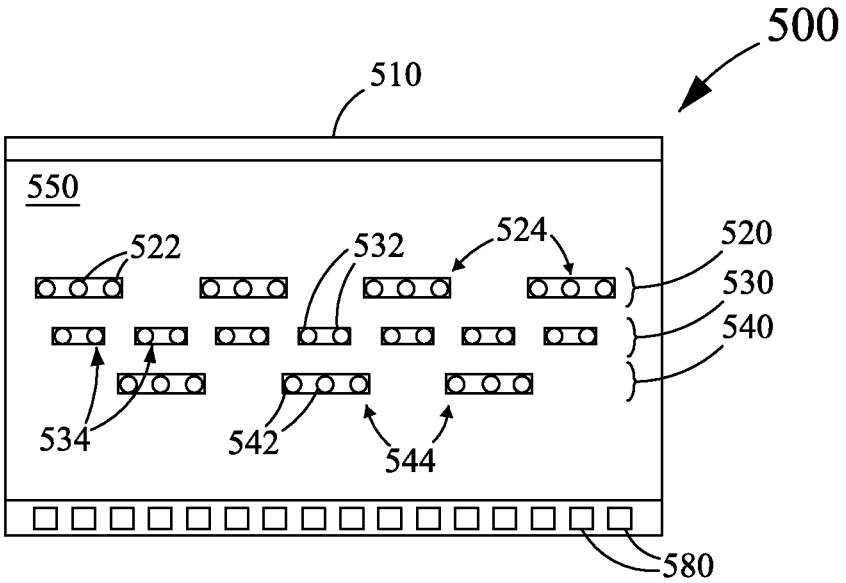
FIG. 11 depicts a top view of a partial layout of the fluid ejection device of FIG. 10 (without the nozzle plate and the flow feature layer) illustrating a layout of transverse bus routing.

Referring to FIGS. 10 and 11, a fluid ejection device 500 for an inkjet printer, in accordance with yet another embodiment of the present disclosure, is disclosed. FIG. 10 depicts a top view of a partial layout of the fluid ejection device 500 illustrating a layout of flow features of a flow feature layer and nozzles of a nozzle plate. FIG. 11 depicts a top view of a partial layout of the fluid ejection device 500 (without a nozzle plate and a flow feature layer) illustrating a layout of transverse bus routing. The fluid ejection device 500 is similar to the fluid ejection devices 300 and 400, and is an ejection device with 1800 dpi print resolution.

As depicted in FIGS. 10 and 11, the fluid ejection device 500 includes a substrate 510 similar to the substrates 310 and 410. The substrate 510 includes at least one trench, such as a trench 512, configured therewithin, as depicted in FIG. 10. It is to be understood that the fluid ejection device 500 is shown to include only one trench. However, any number of trenches may be configured within the fluid ejection device 500, and more specifically, within the substrate 510, as per a manufacturer's preference. Further, the trench 512 is similar to the trenches 312 and 412, and accordingly, a description of the trench 512 is avoided herein for the sake of brevity.

The substrate 510 also includes a plurality of fluid flow vias configured in at least three parallel rows, and more specifically, in three parallel rows, such as a first row 520, a second row 530, and a third row 540, arranged over the trench 512, as depicted in FIG. 10. Specifically, the plurality of fluid flow vias may be configured in a top portion (not shown) of the substrate 510.

The first row 520 includes a first set of fluid flow vias 522 from the plurality of fluid flow vias arranged in a non-uniform manner, as depicted in FIGS. 10 and 11. The first set of fluid flow vias 522 includes a plurality of groups 524 having at least two fluid flow vias 522, as depicted in FIG. 11. In the present embodiment, each of the groups 524 includes three fluid flow vias 522. Further, the each of the groups 524 having the three fluid flow vias 522 is configured at a predetermined distance from an adjacent group of the groups 524. The predetermined distance may be any distance suitable for the fluid ejection device 500. Furthermore, each fluid flow via of the each group of the groups 524 is configured in a spaced-apart relation with an adjacent fluid flow via of the respective each group. Specifically, the each fluid flow via of the each group may be arranged at a predetermined distance of about 1"/900, i.e., 28.2 μm, from the adjacent fluid flow via of the respective each group. Accordingly, each fluid flow via of the first set of fluid flow vias 522 is configured in a spaced-apart relation with an adjacent fluid flow via of the first set of fluid flow vias 522.

The second row 530 is configured at a first predetermined gap from the first row 520. Specifically, the second row 530 may be arranged at a first predetermined gap ranging from about 1"/600, i.e., 42.3 μm, to about 1"/300, i.e., 84.6 μm, from the first row 520. Further, the second row 530 includes a second set of fluid flow vias 532 from the plurality of fluid flow vias arranged in a non-uniform manner, as depicted in FIGS. 10 and 11. The second set of fluid flow vias 532 includes a plurality of groups 534 having at least two fluid flow vias 532, as depicted in FIG. 11. In the present embodiment, each of the groups 534 includes two fluid flow vias 532. Further, the each of the groups 534 having the two fluid flow vias 532 is configured at a predetermined distance from an adjacent group of the groups 534, as depicted by a distance 'D14' in FIG. 10. Specifically, the each group is arranged at a predetermined distance of about 1"/600, i.e., 42.3 μm, from the adjacent group. Furthermore, each fluid flow via of the each group of the groups 534 is configured in a spaced-apart relation with an adjacent fluid flow via of the respective each group, as depicted by a distance 'D15'. Specifically, the each fluid flow via of the each group is arranged at a predetermined distance of about 1"/900, i.e., 28.2 μm, from the adjacent fluid flow via of the respective each group (D14=D15×1.5, or 42.3 μm=28.2 μm×1.5). Accordingly, each fluid flow via of the second set of fluid flow vias 532 is configured in a spaced-apart relation with an adjacent fluid flow via of the second set of fluid flow vias 532.

Similarly, the each fluid flow via of the each group of the groups 524 is configured in a spaced-apart relation with an adjacent fluid flow via of the respective each group, as depicted by the distance 'D15'. Specifically, the each fluid flow via of the each group is arranged at a predetermined distance of about 1"/900, i.e., 28.2 μm, from the adjacent fluid flow via of the respective each group.

The third row 540 is configured at a second predetermined gap from the second row 530. Specifically, the third row 540 may be arranged at a second predetermined gap ranging from about 1"/600, i.e., 42.3 μm, to about 1"/300, i.e., 84.6 μm, from the second row 530. Further, the third row 540 includes a third set of fluid flow vias 542 from the plurality of fluid flow vias arranged in a non-uniform manner, as depicted in FIGS. 10 and 11. The third set of fluid flow vias 542 includes a plurality of groups 544 having at least two fluid flow vias 542, as depicted in FIG. 11. In the present embodiment, each of the groups 544 includes three fluid flow vias 542. Further, the each of the groups 544 having the three fluid flow vias 542 is configured at a predetermined distance from an adjacent group of the groups 544. The predetermined distance may be any distance suitable for the fluid ejection device 500. Furthermore, each fluid flow via of the each group of the groups 544 is configured in a spaced-apart relation with an adjacent fluid flow via of the respective each group. Specifically, the each fluid flow via of the each group may be arranged at a predetermined distance of about 1"/900, i.e., 28.2 μm, from the adjacent fluid flow via of the respective each group. Accordingly, each fluid flow via of the third set of fluid flow vias 542 configured in a spaced-apart relation with an adjacent fluid flow via of the third set of fluid flow vias 542.

The each fluid flow via of the first set of fluid flow vias 522, the second set of fluid flow vias 532, and the third set of fluid flow vias 542, of the each respective first row 520, the second row 530, and the third row 540, is configured in fluid communication with the trench 512 of the at least one trench. Further, the each fluid flow via of the first set of fluid flow vias 522, the second set of fluid flow vias 532, and the third set of fluid flow vias 542, of the respective first row 520, the second row 530, and the third row 540, is further configured in a diagonal relationship relative to a neighboring fluid flow via of an adjacent row of the at least three parallel rows. Specifically, the each fluid flow via of the first set of fluid flow vias 522 of the first row 520 is configured in a diagonal relationship relative to a neighboring fluid flow via of the second set of fluid flow vias 532 of the adjacent second row 530. Similarly, the each fluid flow via of the second set of fluid flow vias 532 of the second row 530 is configured in a diagonal relationship relative to a neighboring fluid flow via of the third set of fluid flow vias 542 of the adjacent third row 540. Specifically, the each fluid flow via of the first set of fluid flow vias 522 may be spaced apart from the neighboring fluid flow via of the second set of fluid flow vias 532 by a distance of about 1"/900, i.e., 28.2 μm (relative shift). Similarly, the each fluid flow via of the third set of fluid flow vias 542 may be spaced apart from the neighboring fluid flow via of the second set of fluid flow vias 532 by a distance of about 1"/900, i.e., 28.2 μm.

Also, the each fluid flow via of the first set of fluid flow vias 522, the second set of fluid flow vias 532, and the third set of fluid flow vias 542 may have a width of about 5 μm and a length of about 16 μm. Without departing from the scope of the present disclosure, the each fluid flow via may have a different width and length based on a manufacturer's preference. Further, the each fluid flow via is configured to have a depth ranging from about 10 μm to about 100 μm, and more specifically, from about 30 μm to about 60 μm. Further, it will be evident that the each fluid flow via is shown to be circular in shape. However, the each fluid flow via may be of any other appropriate shape, such as a rectangular shape. For the purpose of simplicity, solid space of the substrate 510 among each respective fluid flow vias of the first set of fluid flow vias 522, the second set of fluid flow vias 532, and the third set of fluid flow vias 542, is not depicted, and the trench 512 configured underneath is made visible in FIG. 10.

Based on the aforementioned, the arrangement of the plurality of fluid flow vias in the first row 520, the second row 530, and the third row 540, above the trench 512, assists in achieving wider space among the plurality of fluid flow vias for transverse bus routing. FIG. 11 depicts a useful space 550 among the plurality of fluid flow vias for the transverse bus routing.

Further, by virtue of such an arrangement, the 1"/600 wider spacing (edge-to-edge distance 'D14') may be used for transverse bus routing, and specifically for, power distribution lines), and the 1"/900 narrower spacing (distance 'D15') may be used for digital circuit routing. Furthermore, gaps/distances between the first row 520 and the second row 530; and the second row 530 and the third row 540 are also set to further facilitate appropriate transverse bus routing, while allowing the transverse bus routing to take detours on encountering the plurality of fluid flow vias. Additionally as depicted in FIGS. 10 and 11, the each group of the groups 524 in the first row 520 forms a trapezoid with a corresponding neighboring group of the groups 534 in the second row 530, and the each group of the groups 544 in the third row 540 forms a trapezoid with a corresponding neighboring group of the groups 534 in the second row 530. Therefore, the plurality of fluid flow vias is configured as two rows of trapezoids facing each other, wherein the wider spacing provides spaces for transverse bus routing, and specifically, for the power distribution lines to transport high current, and the narrow spacing provides spacing for digital circuit routing.

It will be evident that all the aforementioned distances ('D14' and 'D15') are taken from centers (not numbered) of the respective fluid flow vias, as depicted in FIG. 10.

The fluid ejection device 500 further includes a flow feature layer (not shown), such as the flow feature layer 360 of FIG. 3, configured over the substrate 510. The flow feature layer includes a plurality of flow features 562, as depicted in FIG. 10. Each of the flow features 562 is configured in fluid communication with a corresponding fluid flow via of the plurality of fluid flow vias. The each of the flow features 562 may include a fluid chamber and a flow channel. Further, the each of the flow features 562 of the fluid ejection device 500 may also include one or more filtering pillars, such as a filtering pillar 564 configured within. Furthermore, the fluid ejection device 500 includes a nozzle plate (not shown), such as the nozzle plate 370 of FIG. 3, configured over the flow feature layer. The nozzle plate includes a plurality of nozzles 572, as depicted in FIG. 10. Each of the nozzles 572 is configured in fluid communication with a corresponding flow feature of the flow features 562. Further, and as depicted in FIG. 10, each nozzle-fluid flow via pair is provided to be in fluid communication through the corresponding flow feature, and has the same length of flow path for identical/uniform flow resistance.

It may be evident that the nozzle plate and the flow feature layer may be configured as a single unit. Alternatively, the nozzle plate and the flow feature layer may be configured as separate units.

The fluid ejection device 500 may also include a plurality of fluid ejection elements (not shown) fabricated over the substrate 510 for ejection of a fluid (ink) therefrom. Each fluid ejection element of the plurality of fluid ejection elements may be configured in fluid communication with corresponding one or more fluid flow vias of the plurality of fluid flow vias. Specifically, the fluid may be provided to the trench 512 from one or more fluid reservoirs and may be allowed to flow from the trench 512 to the one or more fluid flow vias, such as one or more fluid flow vias of the first set of fluid flow vias 522, the second set of fluid flow vias 532, and the third set of fluid flow vias 542. For the purpose of simplicity, the plurality of fluid ejection elements is not shown in FIGS. 10 and 11. However, it will be evident that the each fluid ejection element of the plurality of fluid ejection elements may be a fluid ejection element (for example, a resistor) as known in the art.

The fluid ejection device 500 further includes a plurality of electrical interconnects 580 disposed on the substrate 510. Each of the electrical interconnects 580 is configured to communicate at least one of digital signals and power signals to one or more corresponding fluid ejection elements of the plurality of fluid ejection elements through respective digital circuits and power routing. The digital circuits and the power routing are distributed through the space 550 surrounding the plurality of fluid flow vias.

It will be evident that the fluid ejection device 500 having the substrate 510, the flow feature layer, the nozzle plate, and other components, may be fabricated using any technique known in the art.

Figure 12:
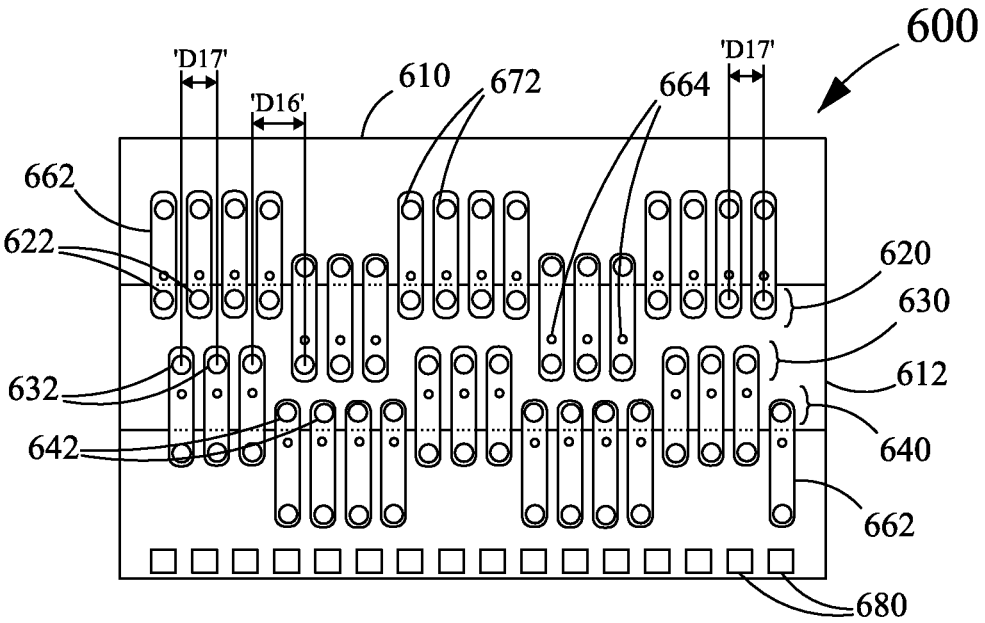
FIG. 12 depicts a top view of a partial layout of a fluid ejection device illustrating a layout of flow features of a flow feature layer and nozzles of a nozzle plate, in accordance with still another embodiment of the present disclosure.
Figure 13:
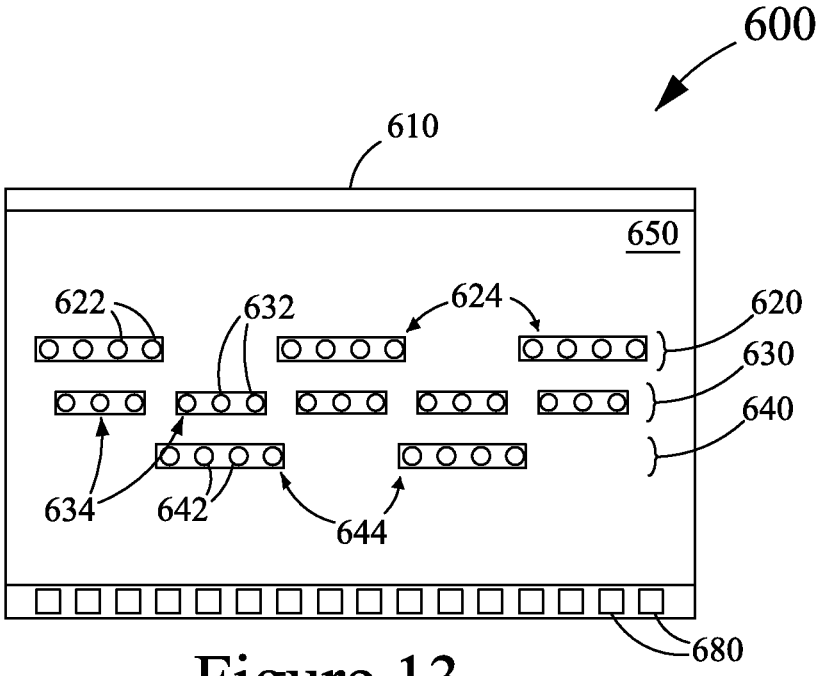
FIG. 13 depicts a top view of a partial layout of the fluid ejection device of FIG. 12 (without the nozzle plate and the flow feature layer) illustrating a layout of transverse bus routing.

Referring to FIGS. 12 and 13, a fluid ejection device 600 for an inkjet printer, in accordance with yet another embodiment of the present disclosure, is disclosed. FIG. 12 depicts a top view of a partial layout of the fluid ejection device 600 illustrating a layout of flow features of a flow feature layer and nozzles of a nozzle plate. FIG. 13 depicts a top view of a partial layout of the fluid ejection device 600 (without the nozzle plate and the flow feature layer) illustrating a layout of transverse bus routing. The fluid ejection device 600 is similar to the fluid ejection device 500, and is an ejection device with 1800 dpi print resolution.

As depicted in FIGS. 12 and 13, the fluid ejection device 600 includes a substrate 610 similar to the substrate 510, and includes at least one trench, such as a trench 612, configured therewithin. The substrate 610 also includes a plurality of fluid flow vias configured in at least three parallel rows, and more specifically, in three parallel rows, such as a first row 620, a second row 630, and a third row 640, arranged over the trench 612, as depicted in FIG. 12. The first row 620 includes a first set of fluid flow vias 622 from the plurality of fluid flow vias arranged in a non-uniform manner, as depicted in FIGS. 12 and 13. The first set of fluid flow vias 622 includes a plurality of groups 624 having four fluid flow vias 622, as depicted in FIG. 13. Further, the each of the groups 624 having the four fluid flow vias 622 is configured at a predetermined distance from an adjacent group of the groups 624. The predetermined distance may be any distance suitable for the fluid ejection device 600. Furthermore, each fluid flow via of the each group of the groups 624 is configured in a spaced-apart relation with an adjacent fluid flow via of the respective each group. Specifically, the each fluid flow via of the each group may be arranged at a predetermined distance of about 1"/900, i.e., 28.2 μm, from the adjacent fluid flow via of the respective each group. Accordingly, each fluid flow via of the first set of fluid flow vias 622 is configured in a spaced-apart relation with an adjacent fluid flow via of the first set of fluid flow vias 622.

The second row 630 is configured at a first predetermined gap from the first row 620. Specifically, the second row 630 may be arranged at a first predetermined gap ranging from about 1"/600, i.e., 42.3 μm, to about 1"/300, i.e., 84.6 μm, from the first row 620. Further, the second row 630 includes a second set of fluid flow vias 632 from the plurality of fluid flow vias arranged in a non-uniform manner, as depicted in FIGS. 12 and 13. The second set of fluid flow vias 632 includes a plurality of groups 634 having three fluid flow vias, as depicted in FIG. 13. Further, the each of the groups 634 having the two fluid flow vias 632 is configured at a predetermined distance from an adjacent group of the groups 634, as depicted by the distance 'D16' in FIG. 12. Specifically, the each group is arranged at a predetermined distance of about 1"/600, i.e., 42.3 μm, from the adjacent group. Furthermore, each fluid flow via of the each group of the groups 634 is configured in a spaced-apart relation with an adjacent fluid flow via of the respective each group, as depicted by the distance 'D17'. Specifically, the each fluid flow via of the each group is arranged at a predetermined distance of about 1"/900, i.e., 28.2 μm, from the adjacent fluid flow via of the respective each group (D16=D17×1.5, or 42.3 μm=28.2 μm×1.5). Accordingly, each fluid flow via of the second set of fluid flow vias 632 is configured in a spaced-apart relation with an adjacent fluid flow via of the second set of fluid flow vias 632.

Similarly, the each fluid flow via of the each group of the groups 624 is configured in a spaced-apart relation with an adjacent fluid flow via of the respective each group, as depicted by the distance 'D17'. Specifically, the each fluid flow via of the each group is arranged at a predetermined distance of about 1"/900, i.e., 28.2 μm, from the adjacent fluid flow via of the respective each group.

The third row 640 is configured at a second predetermined gap from the second row 630. Specifically, the third row 640 may be arranged at a second predetermined gap ranging from about 1"/600, i.e., 42.3 μm, to about 1"/300, i.e., 84.6 μm, from the second row 630. Further, the third row 640 includes a third set of fluid flow vias 642 from the plurality of fluid flow vias arranged in a non-uniform manner, as depicted in FIGS. 12 and 13. The third set of fluid flow vias 642 includes a plurality of groups 644 having four fluid flow vias, as depicted in FIG. 13. The arrangement of the groups 644 is similar to that of the groups 624, accordingly, a description of the groups 644 is avoided herein for the sake of brevity.

The each fluid flow via of the first set of fluid flow vias 622, the second set of fluid flow vias 632, and the third set of fluid flow vias 642, of the each respective first row 620, the second row 630, and the third row 640, is configured in fluid communication with the trench 612 of the at least one trench.

Further, the each fluid flow via of the first set of fluid flow vias 622, the second set of fluid flow vias 632, and the third set of fluid flow vias 642, of the respective first row 620, the second row 630, and the third row 640, is further configured in a manner similar to the each fluid flow via of the first set of fluid flow vias 522, the second set of fluid flow vias 532, and the third set of fluid flow vias 542 of FIG. 10, accordingly, a description of the arrangement of the each fluid flow via is herein avoided for the sake of brevity. Furthermore, the each fluid flow via has a dimension similar to that of the each fluid flow via of the first set of fluid flow vias 522, the second set of fluid flow vias 532, and the third set of fluid flow vias 542. Further, it will be evident that the each fluid flow via is shown to be circular in shape. However, the each fluid flow via may be of any other appropriate shape, such as a rectangular shape.

Based on the aforementioned, the arrangement of the plurality of fluid flow vias in the first row 620, the second row 630, and the third row 640, above the trench 612, assists in achieving wider space among the plurality of fluid flow vias for transverse bus routing. FIG. 13 depicts a useful space 650 among the plurality of fluid flow vias for the transverse bus routing. Further, by virtue of such an arrangement spaces among the plurality of fluid flow vias, the 1"/600 wider spacing (edge-to-edge distance 'D16') may be used for transverse bus routing, and specifically for, power distribution lines, and the 1"/900 narrower spacing (distance 'D17') may be used for digital circuit routing. Additionally and as depicted in FIGS. 12 and 13, the each group of the groups 624 in the first row 620 forms a trapezoid with a corresponding neighboring group of the groups 634 in the second row 630, and the each group of the groups 644 in the third row 640 forms a trapezoid with a corresponding neighboring group of the groups 634 in the second row 630. Therefore, the plurality of fluid flow vias is configured as two rows of trapezoids facing each other, wherein the wider spacing (contributed by 'D16') provides spaces for transverse bus routing, and specifically, for the power distribution lines to transport high current, and the narrow spacing (contributed by 'D17') provides spacing for digital circuit routing. It will be evident that all the aforementioned distances ('D16' and 'D17') are taken from centers (not numbered) of the respective fluid flow vias, as depicted in FIG. 12.

The fluid ejection device 600 further includes a flow feature layer (not shown), such as the flow feature layer 360 of FIG. 3, configured over the substrate 610. The flow feature layer includes a plurality of flow features 662, as depicted in FIG. 12. Each of the flow features 662 is configured in fluid communication with a corresponding fluid flow via of the plurality of fluid flow vias. The each of the flow features 662 may include a fluid chamber and a flow channel. Further, the each of the flow features 662 of the fluid ejection device 600 may also include one or more filtering pillars, such as a filtering pillar 664 configured therewithin. Furthermore, the fluid ejection device 600 includes a nozzle plate (not shown), such as the nozzle plate 370 of FIG. 3, configured over the flow feature layer. The nozzle plate includes a plurality of nozzles 672, as depicted in FIG. 12. Each of the nozzles 672 is configured in fluid communication with a corresponding flow feature of the flow features 662. Further, and as depicted in FIG. 12, each nozzle-fluid flow via pair is provided to be in fluid communication through the corresponding flow feature, and has the same length of flow path for identical/uniform flow resistance.

The fluid ejection device 600 may also include a plurality of fluid ejection elements (not shown) fabricated over the substrate 610 for ejection of a fluid (ink) therefrom. Each fluid ejection element of the plurality of fluid ejection elements may be configured in fluid communication with corresponding one or more fluid flow vias of the plurality of fluid flow vias. Specifically, the fluid may be provided to the trench 612 from one or more fluid reservoirs and may be allowed to flow from the trench 612 to the one or more fluid flow vias, such as one or more fluid flow vias of the first set of fluid flow vias 622, the second set of fluid flow vias 632, and the third set of fluid flow vias 642. For the purpose of simplicity, the plurality of fluid ejection elements is not shown in FIGS. 12 and 13. However, it will be evident that the each fluid ejection element of the plurality of fluid ejection elements may be a fluid ejection element (for example, a resistor) as known in the art.

The fluid ejection device 600 further includes a plurality of electrical interconnects 680 disposed on the substrate 610. Each of the electrical interconnects 680 is configured to communicate at least one of digital signals and power signals to one or more corresponding fluid ejection elements of the plurality of fluid ejection elements through respective digital circuits and power routing. The digital circuits and the power routing are distributed through the space 650 surrounding the plurality of fluid flow vias.

In another aspect, the present disclosure provides a substrate, such as the substrates 310, 410, 510 and 610, for a fluid ejection device, such as the fluid ejection devices 300, 400, 500 and 600, of an inkjet printer. The substrate includes at least one trench, such as the trenches 312, 412, 512 and 612, configured therewithin. The substrate further includes a plurality of fluid flow vias, such as the plurality of fluid flow vias of the fluid ejection devices 300, 400, 500 and 600, configured in at least three parallel rows, such as the first rows 320, 420, 520, and 620; the second rows 330, 430, 530 and 630; and the third rows 340, 440, 540 and 640, arranged over each trench of the at least one trench. As the substrate of the present disclosure is similar to the substrates 310, 410, 510 and 610 that are explained in conjunction with FIGS. 3-13, accordingly, a detailed description of the substrate is herein avoided for the sake of brevity.

The present disclosure provides an efficient and effective fluid ejection device, such as the fluid ejection devices 300, 400, 500 and 600, to allow transverse bus routing through among fluid flow vias thereof while having highly dense nozzles for a print resolution greater than or equal to about 1800 dots per inch (dpi). Further, each nozzle of the fluid ejection device is fed through a single fluid flow via. Specifically, the fluid ejection device includes three rows of fluid flow vias that are optimal to achieve wider space among the fluid flow vias for transverse bus routing. Although, the three rows of the fluid flow vias for the fluid ejection device require a specified thickness of the fluid flow via layer, more than three rows may easily be employed when the thickness of the fluid flow via layer is increased to provide mechanical stability to the fluid ejection device, thereby assisting in widening the space for transverse bus routing. Moreover, any combination of the layouts of the fluid flow vias as depicted in FIGS. 3-13 may be used in a fluid ejection device for transverse bus routing wherein narrow gaps among the fluid flow vias may be used for digital circuit routing, and wide gaps among the fluid flow vias may be used for power distribution lines. Additionally, the thickness of the fluid flow via layer may vary from about 10 μm to about 100 μm for any configuration of the fluid flow vias, i.e., arrangement in two rows, arrangement in three rows, and the like.

Based on the foregoing, the fluid ejection device of the present disclosure provides an optimal arrangement of nozzles, flow feature layer, flow features, fluid flow vias and trenches, which accounts for tolerances in the fabrication process for the nozzle plate, the flow feature layer, trenches, and the digital circuit and power bus routing. Such tolerances limit the minimum spacing (and therefore print resolution) using traditional arrangements. Therefore, the fluid ejection device of the present disclosure assists in optimizing the position of the aforementioned components including the trenches, fluid flow vias, flow feature layer, and nozzle plate, with respect to each other to minimize the spacing between the nozzles for an improved print resolution while accounting for the fabrication tolerances of the aforementioned components.

In alternate embodiments, a different set of fabrication tolerances could result in different structural arrangements. As is shown, structural arrangements reveal elements of three rows with groups of two and groups of three nozzles or groups of three and groups of four nozzles and these relate to the technologies selected: deep reactive ion etch, ultra low energy heaters, and photo image-able nozzle plates. With a different set of fabrication tolerances (arising from different chosen technologies), possible structural arrangements of the elements could include rows of four or five or more with groups of nozzles from two to five, or more.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

The invention claimed is:

1. A fluid ejection device for an inkjet printer, the fluid ejection device comprising:

a substrate comprising, at least one trench configured for flowing a common color of fluid therewithin, and a plurality of fluid flow vias configured in at least three parallel rows arranged over the at least one trench to flow the common color of fluid above the at least one trench, each row of the at least three parallel rows comprising a set of fluid flow vias from the plurality of fluid flow vias arranged in one of a uniform manner and a non-uniform manner such that each fluid flow via of the set of fluid flow vias is configured in a spaced-apart relation with an adjacent fluid flow via of the set of fluid flow vias, the each fluid flow via of the set of fluid flow vias of the each row further configured in a diagonal relationship relative to a neighboring fluid flow via of all adjacent rows of the at least three parallel rows;

a flow feature layer configured over the substrate, the flow feature layer comprising a plurality of flow features, each flow feature of the plurality of flow features configured in fluid communication with a corresponding fluid flow via of the plurality of fluid flow vias; and a nozzle plate configured over the flow feature layer so that the plurality of fluid flow vias is disposed between the at least one trench and the nozzle plate, the nozzle plate comprising a plurality of nozzles, each nozzle of the plurality of nozzles configured in fluid communication with a corresponding flow feature of the plurality of flow features to eject fluid drops of the common color of fluid.

2. The fluid ejection device of claim 1, wherein the plurality of fluid flow vias is configured in three rows arranged over the each trench of the at least one trench, the three rows comprising, a first row having a first set of fluid flow vias from the plurality of fluid flow vias arranged in a uniform manner, such that each fluid flow via of the first set of fluid flow vias is arranged at a predetermined distance from an adjacent fluid flow via, a second row configured at a first predetermined gap from the first row, the second row having a second set of fluid flow vias from the plurality of fluid flow vias arranged in a uniform manner, such that each fluid flow via of the second set of fluid flow vias is arranged at a predetermined distance from an adjacent fluid flow via, and a third row configured at a second predetermined gap from the second row, the third row having a third set of fluid flow vias from the plurality of fluid flow vias arranged in a uniform manner, such that each fluid flow via of the third set of fluid flow vias is arranged at a predetermined distance from an adjacent fluid flow via, wherein the first predetermined gap is equal to the second predetermined gap, and the predetermined distance between the adjacent fluid flow vias of the first row is equal to the predetermined distance between the adjacent fluid flow vias of the second row and the predetermined distance between the adjacent fluid flow vias of the third row.

3. The fluid ejection device of claim 1, wherein the plurality of fluid flow vias is configured in three rows arranged over the each trench of the at least one trench, the three rows comprising, a first row having a first set of fluid flow vias from the plurality of fluid flow vias arranged in a non-uniform manner, wherein the first set of fluid flow vias comprises a plurality of groups having at least two fluid flow vias, each group of the plurality of groups having the at least two fluid flow vias being configured at a predetermined distance from an adjacent group of the plurality of groups, a second row configured at a first predetermined gap from the first row, the second row having a second set of fluid flow vias from the plurality of fluid flow vias arranged in one of a uniform manner and a non-uniform manner, and a third row configured at a second predetermined gap from the second row, the third row having a third set of fluid flow vias from the plurality of fluid flow vias arranged in a non-uniform manner, wherein the third set of fluid flow vias comprises a plurality of groups having at least two fluid flow vias, each group of the plurality of groups having the at least two fluid flow vias being configured at a predetermined distance from an adjacent group of the plurality of groups, wherein the predetermined distance between the adjacent groups of the plurality of groups in the first row is equal to the predetermined distance between the adjacent groups of the plurality of groups in the third row.

4. The fluid ejection device of claim 3, wherein the second set of fluid flow vias of the second row is arranged in a uniform manner, such that each fluid flow via of the second set of fluid flow vias is arranged at a predetermined distance from an adjacent fluid flow via.

5. The fluid ejection device of claim 4, wherein the each group of the plurality of groups in the first row comprises two fluid flow vias, and the each group of the plurality of groups in the third row comprises two fluid flow vias.

6. The fluid ejection device of claim 5, wherein the each group of the plurality of groups in the first row forms a triangle with a corresponding neighboring fluid flow via of the second row, and the each group of the plurality of groups in the third row forms a triangle with a corresponding neighboring fluid flow via of the second row.

7. The fluid ejection device of claim 3, wherein the second set of fluid flow vias of the second row is arranged in a non-uniform manner, and wherein the second set of fluid flow vias comprises a plurality of groups having at least two fluid flow vias, each group of the plurality of groups having the at least two fluid flow vias being configured at a predetermined distance from an adjacent group of the plurality of groups.

8. The fluid ejection device of claim 7, wherein the each group of the plurality of groups in the first row forms a trapezoid with a corresponding neighboring group of the plurality of groups in the second row, and the each group of the plurality of groups in the third row forms a trapezoid with a corresponding neighboring group of the plurality of groups in the second row.

9. The fluid ejection device of claim 8, wherein the each group of the plurality of groups in the first row has three fluid flow vias, and wherein the each group of the plurality of groups in the third row has three fluid flow vias.

10. The fluid ejection device of claim 3, wherein the second set of fluid flow vias of the second row is arranged in a non-uniform manner, and wherein the second set of fluid flow vias comprises a plurality of groups having three fluid flow vias, each group of the plurality of groups having the three fluid flow vias being configured at a predetermined distance from an adjacent group of the plurality of groups.

11. The fluid ejection device of claim 10, wherein the each group of the plurality of groups in the first row forms a trapezoid with a corresponding neighboring group of the plurality of groups in the second row, and the each group of the plurality of groups in the third row forms a trapezoid with a corresponding neighboring group of the plurality of groups in the second row.

12. The fluid ejection device of claim 11, wherein the each group of the plurality of groups in the first row has four fluid flow vias, and wherein the each group of the plurality of groups in the third row has four fluid flow vias.

13. The fluid ejection device of claim 1, further comprising a plurality of fluid ejection elements fabricated over the substrate, each fluid ejection element of the plurality of fluid ejection elements configured in fluid communication with corresponding one or more fluid flow vias of the plurality of fluid flow vias.

14. The fluid ejection device of claim 13, further comprising a plurality of electrical interconnects disposed on the substrate, each electrical interconnect of the plurality of electrical interconnects configured to communicate at least one of digital signals and power signals to one or more corresponding fluid ejection elements of the plurality of fluid ejection elements through respective digital circuits and power routing, wherein the digital circuits and the power routing are distributed through space surrounding the plurality of fluid flow vias.

15. The fluid ejection device of claim 1, wherein the each trench of the at least one trench is configured along a length of the fluid ejection device.

16. The fluid ejection device of claim 1, wherein the each trench of the at least one trench is configured to have a width ranging from about 100 micrometers (.mu.m) to about 150 .mu.m.

17. The fluid ejection device of claim 1, wherein the each fluid flow via of the plurality of fluid flow vias is configured to have a depth ranging from about 30 .mu.m to about 60 .mu.m.

18. A substrate for a fluid ejection device of an inkjet printer, the substrate comprising:

at least one trench configured for flowing a common color of fluid therewithin; and a plurality of fluid flow vias disposed between the at least one trench and a nozzle plate, the plurality of fluid flow vias configured in at least three parallel rows arranged over the at least one trench to flow the common color of fluid above the at least one trench, each row of the at least three parallel rows comprising a set of fluid flow vias from the plurality of fluid flow vias arranged in one of a uniform manner and a non-uniform manner such that each fluid flow via of the set of fluid flow vias is configured in a spaced-apart relation with an adjacent fluid flow via of the set of fluid flow vias, the each fluid flow via of the set of fluid flow vias of the each row further configured in a diagonal relationship relative to a neighboring fluid flow via of all adjacent rows of the at least three parallel rows.

* * * * *